US011013090B2

(12) United States Patent
Bergman et al.

(10) Patent No.: US 11,013,090 B2
(45) Date of Patent: May 18, 2021

(54) CONTROLLER AND METHOD FOR GENERATING A DYNAMIC LIGHT EFFECT ON A LIGHT SOURCE ARRAY

(71) Applicant: SIGNIFY HOLDING B.V., Eindhoven (NL)

(72) Inventors: Anthonie Hendrik Bergman, Eindhoven (NL); Jochen Renaat Gheluwe, Eindhoven (NL); Bartel Marinus Van De Sluis, Eindhoven (NL); Ramon Antoine Wiro Clout, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/634,218

(22) PCT Filed: Jul. 19, 2018

(86) PCT No.: PCT/EP2018/069611
§ 371 (c)(1),
(2) Date: Jan. 27, 2020

(87) PCT Pub. No.: WO2019/020482
PCT Pub. Date: Jan. 31, 2019

(65) Prior Publication Data

US 2021/0092817 A1 Mar. 25, 2021

(30) Foreign Application Priority Data

Jul. 26, 2017 (EP) ..... 17183206

(51) Int. Cl.
*H05B 47/155* (2020.01)
*H05B 47/105* (2020.01)
*H05B 45/24* (2020.01)

(52) U.S. Cl.
CPC ..... *H05B 47/105* (2020.01); *H05B 45/24* (2020.01); *H05B 47/155* (2020.01)

(58) Field of Classification Search
CPC ..... H05B 45/10; H05B 45/20; H05B 45/24; H05B 47/11; H05B 47/105; H05B 47/155;
(Continued)

(56) References Cited

U.S. PATENT DOCUMENTS 7,202,613 B2 * 4/2007 Morgan ..... H05B 47/10 315/312
8,207,821 B2 * 6/2012 Roberge ..... H05B 45/355 340/9.11
(Continued)

FOREIGN PATENT DOCUMENTS

EP 3002512 A1 4/2016

*Primary Examiner* — Haissa Philogene

(57) ABSTRACT

A method (700) of generating a dynamic light effect on a light source array (110) is disclosed. The light source array (110) comprises a plurality of individually controllable light sources (112). The method (700) comprises: obtaining (702) or generating (702) a vector, wherein the vector has a plurality of behavior parameters comprising at least a speed and a direction, and the vector has one or more appearance parameters comprising at least a color and/or a brightness, mapping (704) the vector onto the light source array (110) over time according to the behavior parameters of the vector, and controlling (706) the light output of the plurality of light sources (112) over time according to the mapping of the vector onto the light source array (110) and according to the appearance parameters of the vector.

13 Claims, 6 Drawing Sheets

(58) Field of Classification Search
CPC ..... H05B 47/19; G09F 13/22; G05F 13/005; G05F 2013/222; F21V 23/045; F21Y 2103/10; F21Y 2115/10
See application file for complete search history.

(56) References Cited

U.S. PATENT DOCUMENTS

| | | | | |
|---|---|---|---|---|
| 8,912,905 | B2 * | 12/2014 | Wong | H05B 45/37 340/572.4 |
| 9,429,926 | B2 | 8/2016 | Love | |
| 9,781,801 | B2 * | 10/2017 | Hoss | H05B 45/20 |
| 10,728,989 | B2 * | 7/2020 | Aliakseyeu | H05B 47/155 |
| 10,765,237 | B2 * | 9/2020 | Bergman | G06Q 30/02 |
| 2003/0057887 | A1 | 3/2003 | Dowling et al. | |
| 2005/0248299 | A1 | 11/2005 | Chemel et al. | |
| 2017/0150586 | A1 | 5/2017 | Ishibashi et al. | |
| 2017/0167670 | A1 | 6/2017 | Aliakseyeu et al. | |
| 2019/0335560 | A1 * | 10/2019 | Kurvers | H05B 45/20 |

* cited by examiner

CONTROLLER AND METHOD FOR GENERATING A DYNAMIC LIGHT EFFECT ON A LIGHT SOURCE ARRAY

CROSS-REFERENCE TO PRIOR APPLICATIONS

This application is the U.S. National Phase application under 35 U.S.C. § 371 of International Application No. PCT/EP2018/069611, filed on Jul. 19, 2018, which claims the benefit of European Patent Application No. 17183206.6, filed on Jul. 26, 2017. These applications are hereby incorporated by reference herein.

FIELD OF THE INVENTION

The invention relates to a method of generating a dynamic light effect on a light source array. The invention further relates to a computer program product for executing the method. The invention further relates to a controller for generating a dynamic light effect on a light source array.

BACKGROUND

Light strips (e.g. LED strips) with individually controllable light sources enable creation of dynamic light effects such as light effects that resemble a fire, a sunrise/sunset, fireworks, etc. Such light effects are currently preprogrammed. A disadvantage of such preprogrammed light effects is that only dedicated lighting devices can interpret these preprogrammed effects, and that if a user would want a similar effect on another lighting device, he or she would have to program the similar effect for the other lighting device.

U.S. patent application 2005/0248299 A1 discloses a lighting system manager, a light show composer, a light system engine, and related facilities for the convenient authoring and execution of lighting shows. A graphical representation from a light system configuration facility can be delivered to a conversion module, which associates position information from the configuration facility with information from the graphical representation and converts the information into a control signal a light system. The conversion module maps positions in the graphical representation to positions of light systems in the environment. The mapping, for instance a mapping of vector coordinate information, might be a one-to-one mapping of pixels or groups of pixels in the graphical representation to the light system. The lighting system may be a rectangular array formed by suitably arranging a curvilinear string of lighting units. The string of lighting units may use a serial addressing protocol.

SUMMARY OF THE INVENTION

It is an object of the present invention to provide a versatile way of generating dynamic light effects for different types of light source arrays.

According to a first aspect of the present invention, the object is achieved by a method of generating a dynamic light effect on a light source array, the light source array comprising a plurality of individually controllable light sources, the method comprising:

obtaining or generating a vector, wherein the vector has a plurality of behavior parameters comprising at least a speed and a direction, and the vector has one or more appearance parameters comprising at least a color and/or a brightness, mapping the vector onto the light source array over time according to the behavior parameters of the vector, and controlling the light output of the plurality of light sources over time according to the mapping of the vector onto the light source array and according to the appearance parameters of the vector.

By using a vector as an input for a light source array, such as an LED strip or an LED matrix, the light source array does not require a preprogrammed light effect. The light effects that are created by controlling the plurality of light sources are defined by their behavior and appearance parameters. This requires no programming by a lighting designer, which makes it easy for a user to define dynamic light effects (i.e. light effects that change over time), for example by setting a number of vectors and their parameters.

Another benefit of this method, is that it enables creation of a light effect that is independent on the type of lighting device to which it is applied. If a light effect having a two-dimensional direction and a certain speed would be applied to a one-dimensional lighting array, such as an LED strip, the vector (and therewith the light effect created by that vector) would be mapped onto the LED array and move in a one-dimensional direction according to the direction and the speed defined by its behavior parameters. If the same light effect would be applied to a two-dimensional lighting array, such as an LED grid, the vector (and therewith the light effect created by that vector) would move in a two-dimensional direction according to the direction and the speed defined by its behavior parameters. Thus, the perception of the light effect (i.e. the moving vector) would be similar for a one-dimensional array compared to a two-dimensional array.

The behavior of the vector relates to a spatial and temporal motion of the light effect when the vector is mapped on the light source array. The appearance of the vector relates to how the light effect looks at any moment when the light sources are controlled based on the vector.

The vector may be received as a lighting control command from a lighting control device, such as a smartphone, a router or a bridge. The lighting control command may comprise information about the behavior parameters and the one or more appearance parameters of the vector. Additionally, the lighting control command may comprise information indicative of a number of vectors that are to be mapped onto the light source array. In known LED strip control systems, preprogrammed light effects are communicated as lighting control commands to the LED strip. These preprogrammed light effects are either continuously streamed to the LED strip via a network such that the LED strip is controlled accordingly over time, or the preprogrammed light effects are stored in one file, which comprises timing information and light setting information for each time slot for the plurality of light sources of the array. Transmitting these preprogrammed dynamic light effects to the LED strip may put quite a burden on the network, because they comprise information about the mapping of light effects for each moment in time. Therefore, it is beneficial to transmit lighting control commands comprising the vector and its behavior and appearance parameters (only), because this reduces the bandwidth required for transmitting a dynamic light effect from the lighting control device to the light source array. This does not require the lighting control device to send a preprogrammed light effect, because the determination/calculation of how the light effect will be rendered on the individually controllable light sources occurs locally (i.e. at the light source array).

The plurality of behavior parameters may further comprise an initial starting position of the vector, and the vector may be mapped onto the light source array at the initial starting position. This behavior parameter indicates the starting position of the vector on the light source array.

The one or more appearance parameters may further comprise a shape and/or a size of the vector. The shape and/or the size of the vector may be indicative of a number of neighboring light sources (in one or more directions) that are controlled simultaneously when the vector is mapped onto the light source array.

The plurality of behavior parameters may further comprise a lifetime of the vector. The lifetime may be indicative of how long the vector will be rendered on the light source array.

The method may further comprise: changing at least one behavior parameter, other than the lifetime, and/or at least one appearance parameter of the vector as a function of the lifetime. For instance, the speed, color and/or brightness of the vector may be a function of its lifetime.

An area of influence may be mapped onto the light source array. The method may further comprise:

- changing at least one behavior parameter and/or at least one appearance parameter of the vector if the vector is located in the area of influence, or
- generating at least one additional vector if the vector is located in the area of influence. The area of influence may influence at least one behavior parameter and/or at least one appearance parameter of the vector when the vector passes/enters/exits the area of influence. Additionally or alternatively, an additional vector may be generated when the (initial) vector is located in the area of influence. This is beneficial, because the area of influence changes the way the vector will be perceived by a user.

The area of influence may be mapped at a location relative to the light source array based on a user input indicative of a selection of an input location relative to the light source array. The user may provide the user input via a user interface of a smart device, such as a smartphone, or the user may provide the user input at the light source array and the light source array may comprise one or more sensors for receiving the user input. This is beneficial, because it enables a user to determine where the behavior and/or the appearance of the vector should be changed. Additionally, the user may provide a further user input indicative of how the behavior and/or the appearance of the vector changes. This is beneficial, because it enables a user to determine how the behavior and/or the appearance of the vector should be changed when the vector passes/enters/exits the area of influence.

The area of influence may be mapped at a location relative to the light source array based on a location of an attachable component relative to the light source array, which attachable component has been attached to the light source array by a user. This is beneficial, because it enables a user to determine where the behavior and/or the appearance of the vector should be changed when the vector passes the attachable component, simply by attaching the attachable component to the light source array. If the user has a set of attachable components, each influencing the behavior and/or the appearance of the vector in a different way, the user is able to select one of the attachable components and determine how (and where) the behavior and/or the appearance of the vector changes when the vector passes the attachable component.

The method may further comprise: changing, if the vector collides with a second vector, at least one behavior parameter and/or at least one appearance parameter of the vector. This enables interaction between multiple vectors. Additionally, the change of the at least one behavior parameter and/or the at least one appearance parameter of the vector may be based on at least one behavior parameter and/or at least one appearance parameter of the second vector.

Any change of at least one behavior parameter and/or at least one appearance may be temporary.

At least one of the plurality of behavior parameters and/or at least one of the appearance parameters may be defined by a user. The behavior parameters and/or the appearance parameters may be defined by a user input received via a user interface. This enables a user to determine how the vectors will move, look and/or interact with each other or with areas of influence when they are mapped onto the light source array.

According to a second aspect of the present invention, the object is achieved by a computer program product for a computing device, the computer program product comprising computer program code to perform the method of any above-mentioned method when the computer program product is run on a processing unit of the computing device.

According to a third aspect of the present invention, the object is achieved by a controller for generating a dynamic light effect on a light source array, the light source array comprising a plurality of individually controllable light sources, wherein the controller is configured to:

- obtain or generate a vector, wherein the vector has a plurality of behavior parameters comprising at least a speed and a direction, and the vector has one or more appearance parameters comprising at least a color and/or a brightness,
- map the vector onto the light source array over time according to the behavior parameters of the vector, and
- control the light output of the plurality of light sources over time according to the mapping of the vector onto the light source array and according to the appearance parameters of the vector.

It should be understood that the device may have similar and/or identical embodiments and advantages as the claimed methods.

BRIEF DESCRIPTION OF THE DRAWINGS

The above, as well as additional objects, features and advantages of the disclosed devices and methods will be better understood through the following illustrative and non-limiting detailed description of embodiments of devices and methods, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF EMBODIMENTS

Figure 1:
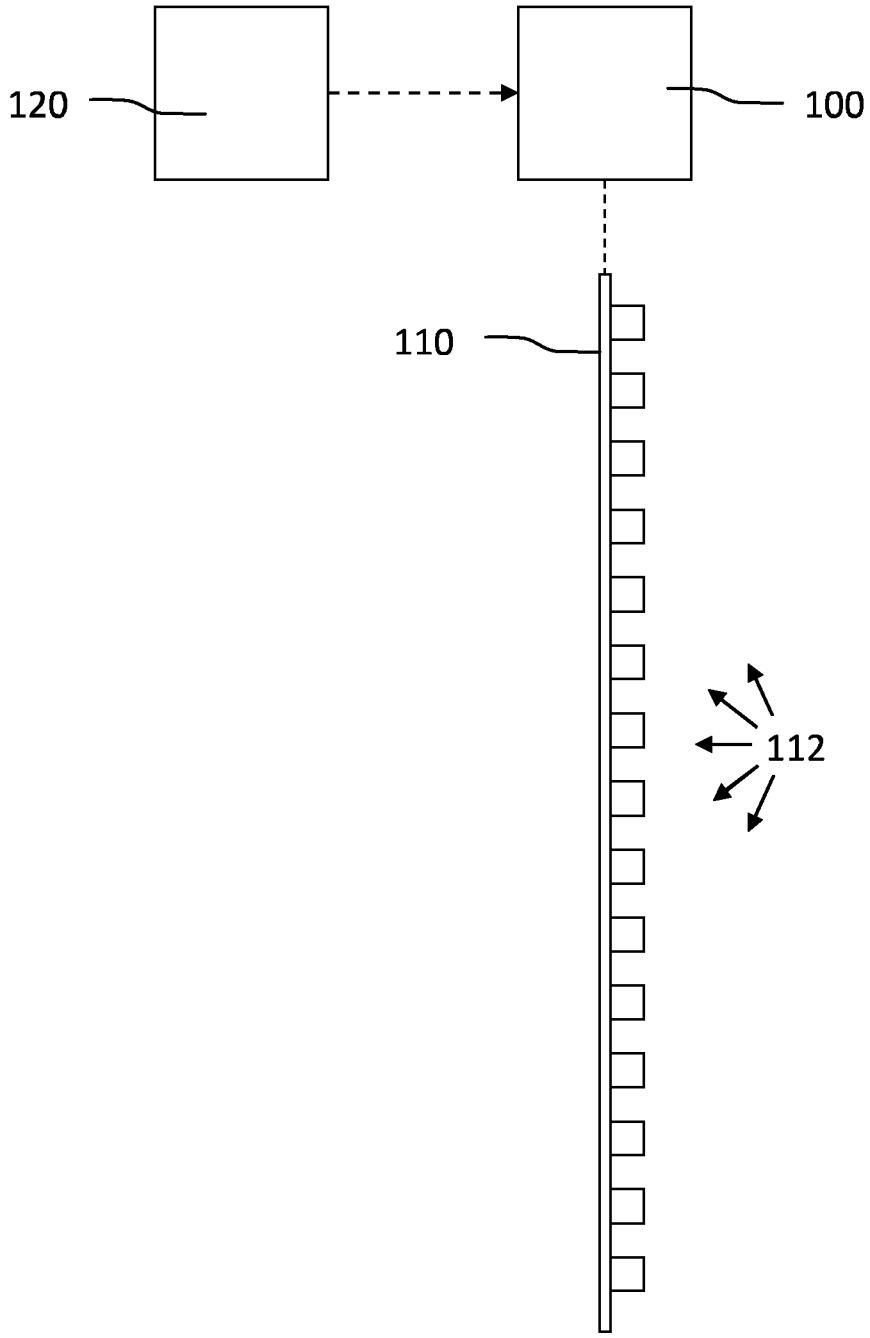
FIG. 1 shows schematically an embodiment of a system comprising a controller for generating a dynamic light effect on a light source array.

FIG. 1 shows schematically an embodiment of a system comprising a controller 100 for generating a dynamic light effect on a light source array 110. The light source array 110 comprises a plurality of individually controllable light sources 112. The controller 100 is configured to obtain or generate a vector. The vector has a plurality of behavior parameters comprising at least a speed and a direction, and the vector has one or more appearance parameters comprising at least a color and/or a brightness. The controller 100 is further configured to map the onto the light source array 110 over time according to the behavior parameters of the vector, and to control the light output of the plurality of light sources 112 over time according to the mapping of the vector onto the light source array 110 and according to the appearance parameters of the vector.

The controller 100 may be configured to obtain the vector. The vector may for example be comprised in a lighting control command received from a further device 120. The further device, for example a remote server, a bridge, a smart device such as a smartphone, etc. may be configured to transmit the lighting control command to the controller 100. The lighting control command may comprise information about the vector, which information may comprise the behavior and appearance parameters of the vector. Additionally, the information may be indicative of a number of vectors that are to be rendered on the light source array 110, and the controller 100 may map these vectors on the light source array 110 and control the light sources 112 accordingly.

The controller 100 may be configured to generate the vector. The vector may be generated based on an input signal. The input signal may, for example, be a voice command, a touch input received via a touch interface, a presence signal received from a presence sensor, etc.). The input signal may be received from a further device 120, or it may be received from a sensor comprised in the controller 100. The controller 100 may be further configured to determine the behavior parameters and the appearance parameters of the vector. These parameters may for example be predetermined, be determined randomly or based on the input signal.

The vector may be defined as a "particle" that has behavior parameters being at least speed and direction. The behavior defines the spatial and temporal motion of the light effect when the vector is mapped on the light source array 110. The speed of the vector may be defined by the distance that is covered by the vector over a certain amount of time. The speed may, for example, be expressed in length units per second (e.g. m/s), or in number of light sources per second. The controller 100 may comprise information about the light source array 110, for example about its length and/or its number of light sources. The controller 100 may use the length and/or the number of light sources to map the vector onto the light source array over time according to its speed. The direction of the vector may be defined as an absolute or relative value, for example as a direction relative to an origin point of the light source array 100. The direction may be one-dimensional or multidimensional. In an embodiment wherein the light source array 110 is a one-dimensional array (e.g. an LED strip), the controller 100 may be configured to map the vector onto the light source array over time based on a one-dimensional direction. Additionally, the controller 100 may be configured to map the vector onto the one-dimensional light source array over time based on a two-dimensional direction (if the direction, for example, has an x-component and an y-component, the controller may map the vector onto the light source array according to the x-component only). This is beneficial, because it enables mapping of multidimensional vectors onto different types of light source arrays, ranging from one-dimensional to three-dimensional light source arrays.

Figure 2:
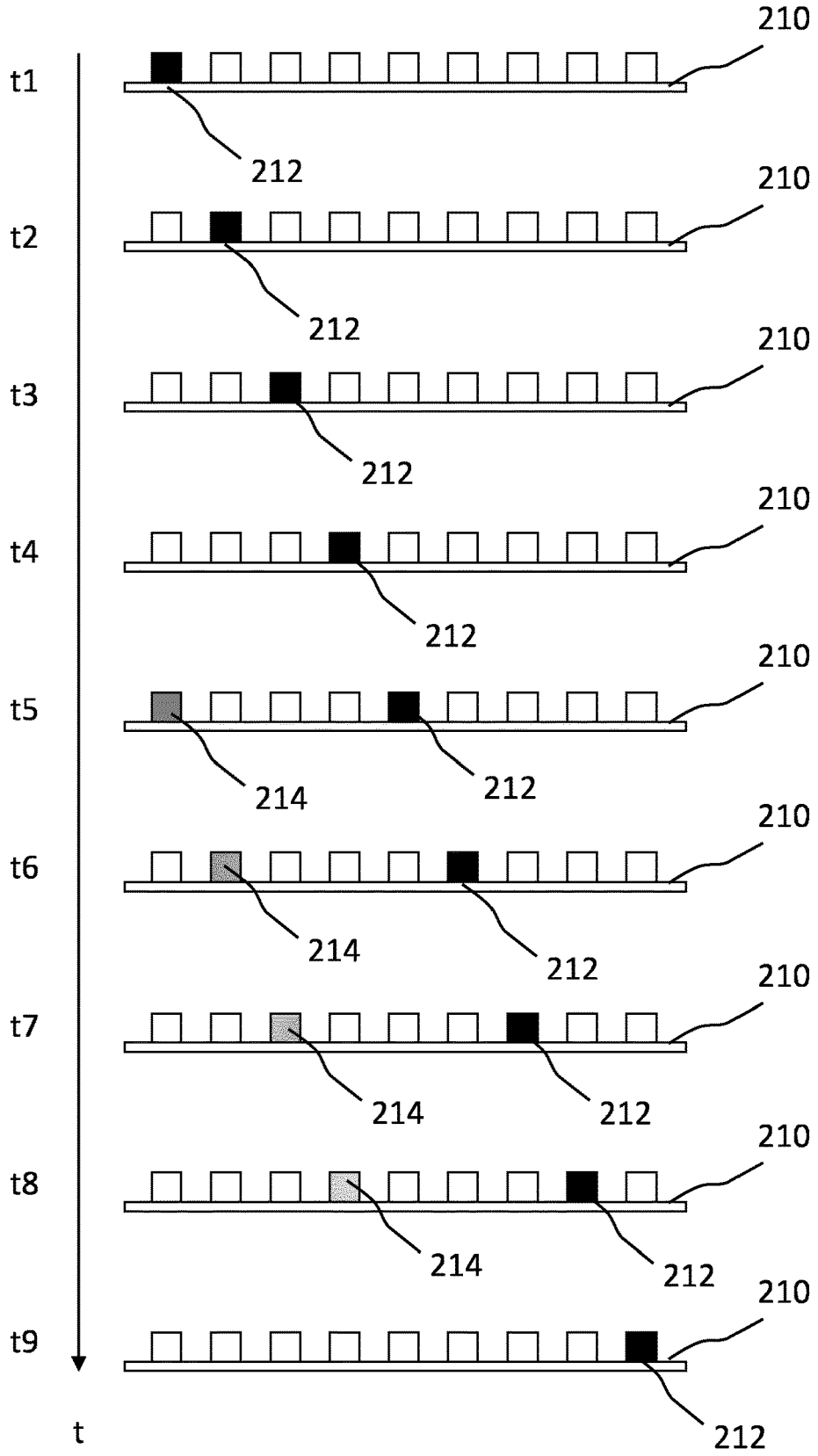
FIG. 2 shows schematically an embodiment of a mapping of a vector on a light source array over time.

FIG. 2 illustrates an example of how a vector may be mapped onto a light source array 210. The vector, in FIG. 2 depicted as a light source 212 that has been turned on, has a direction (left to right) and a speed (one light source per time interval). The controller 100 may map the vector onto the light source array over time, such that it moves from left to right at one light source per time interval. Based on this mapping, the controller may control the light sources of the light source array 210 over time subsequently, such that the light effect that is created by controlling the light sources moves from left to right from time t1 to t9.

The vector/particle further has one or more appearance parameters comprising at least a color and/or a brightness. The appearance of the vector relates to how the light effect looks at any moment when the light sources are controlled based on the vector. An appearance parameter may be a color, for example red, and the controller 100 may control a light source to which the vector has been mapped at a certain moment in time such that it emits red light. Additionally or alternatively, an appearance parameter may be a brightness, for example an intensity level of 50%, and the controller 100 may control a light source to which the vector has been mapped at a certain moment in time such that it emits light at a 50% intensity level.

The controller 100 may be configured to receive signals (e.g. lighting control commands or other input signals) from the further device 120. The further device 120 may comprise a transmitter comprising hardware for transmitting the signals via any wired or wireless communication protocol to the controller 100, and the controller 100 may comprise a corresponding receiver. Various wired and wireless communication protocols may be used, for example Ethernet, DMX, DALI, USB, Bluetooth, Wi-Fi, Li-Fi, 3G, 4G or ZigBee.

The light source array 110 may be any type of light source array 110 comprising a plurality of individually controllable light sources 112. The light source array 110 may be a one-dimensional array (e.g. an LED strip), a two-dimensional array (e.g. an LED grid) or a three-dimensional array (e.g. an LED cube). The light sources 112 may be configured to be powered by a power line, and to receive control commands via a data line. Each light source may have an individual address, and control commands sent form the controller 100 via the data line may comprise control commands addressed to specific light sources that are to be controlled. Alternatively, the controller 100 may be configured to communicate a data signal via the data line comprising a plurality of sets of bits comprising control instructions for the individual light sources. Each individually controllable light source may remove a set of bits from the data signal and use this set of bits to control its light output, and forward the remainder of the data signal to the next light source.

The controller 100 may be comprised in/attached to the light source array 110. The controller 100 may power the light sources 112 via one or more power lines, and communicate control commands to the light sources 112 of the light source array 110 via one or more data lines. Alternatively, the controller 100 may be located remotely from the light source array 110, and the controller 100 may be configured to communicate control commands to the light source array 110 via a wired or wireless communication protocols, for example Ethernet, DMX, DALI, USB, Bluetooth, Wi-Fi, Li-Fi, 3G, 4G or ZigBee.

The controller 100 may be configured to control a plurality of light source arrays. The controller 100 may be further configured to map a vector on the plurality of light source arrays. The controller 100 may, for example, map a vector (first) on a first light source array, and subsequently on a second light source array, such that the vector moves from the first to the second light source array.

The controller 100 may be further configured to obtain or determine an initial starting position for the vector as a behavior parameter of the of the vector and map the vector onto the light source array 110 accordingly. The controller 100 may be further configured to map the vector at the starting position when the vector is being mapped onto the light source array 110. The starting position may be a random position, a user defined position or a predetermined position. In the example of FIG. 2, the starting position of the vector 212 is the position of the left light source.

The controller 100 may be further configured to obtain or determine a shape and/or a size of the vector as an appearance parameter of the vector and control the light output of the plurality of light sources 112 accordingly. In the example of FIG. 2, the vector 212 is shaped as a dot that moves along the light source array 210. The size/shape of the vector may, for example, be such that also neighboring light sources (in one or more directions) are simultaneously controlled when the vector is mapped onto the light source array. In an embodiment, wherein the light source array 110 is a two-dimensional or three-dimensional array, the vector may for example be star-shaped, square/box-shaped, circular/spherical, etc.

The controller 100 may be further configured to obtain or determine a lifetime as a behavior parameter of the of the vector and map the vector onto the light source array 110 accordingly. The lifetime is indicative of how long the vector will be mapped onto the light source. FIG. 2 illustrates an example of a vector 214 that 'lives' for 4 time periods (t5 to t8). The controller 100 may be further configured to change at least one behavior parameter, other than the lifetime, and/or at least one appearance parameter of the vector as a function of the lifetime. The controller 100 may, for example, determine the speed of the vector as a function of its lifetime, or, as illustrated in FIG. 2, the controller 100 may for example decrease the color and/or brightness of the vector 214 as a function of its lifetime.

Figure 3:
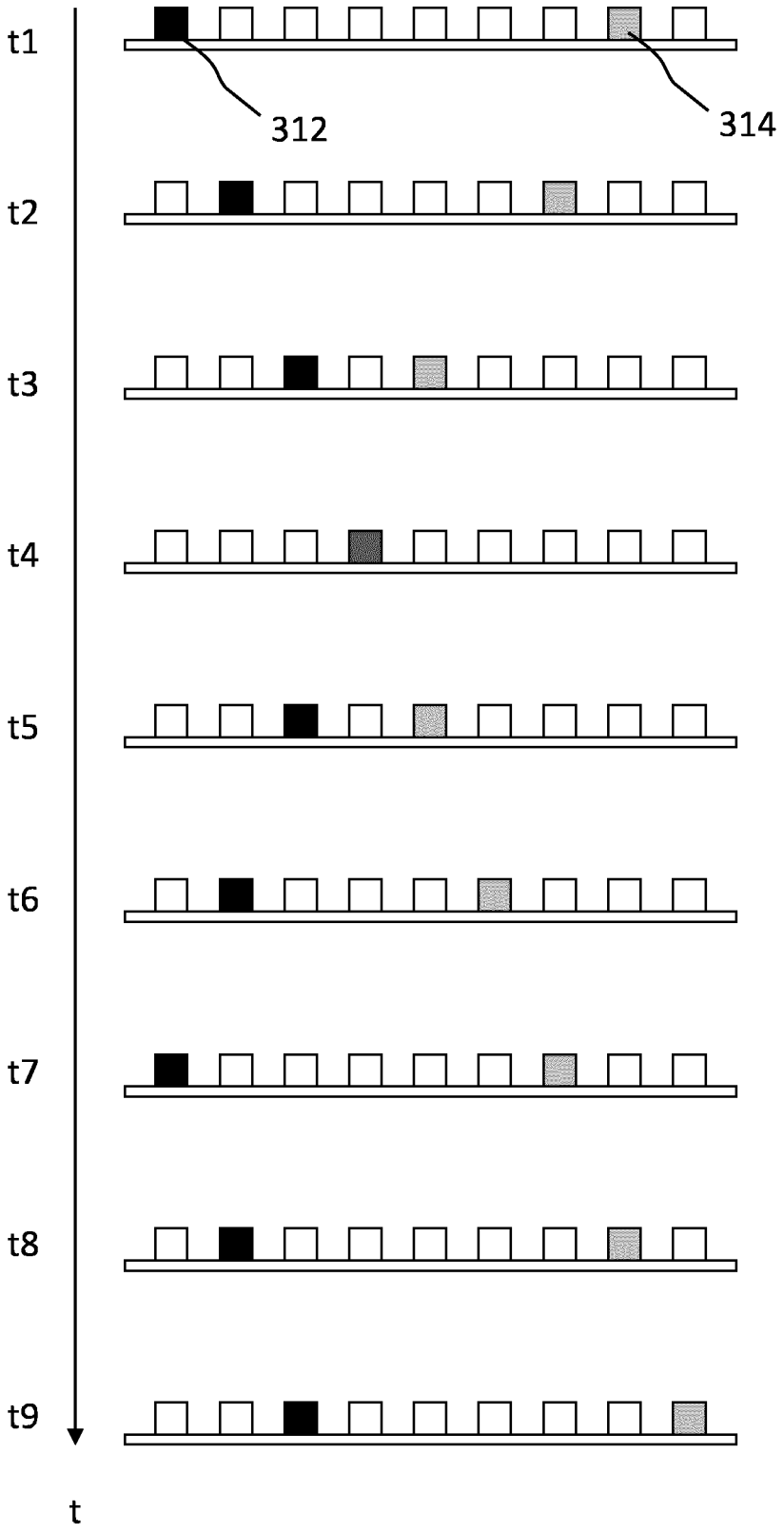
FIG. 3 shows schematically an embodiment of two vectors colliding over time.

The controller 100 may be further configured for changing at least one behavior parameter and/or at least one appearance parameter of the vector if the vector collides with a second vector. FIG. 3 illustrates an example of a change in behavior (direction) when a first vector 312 and a second vector 314 collide. In this example, the first vector 312 moves from left to right from t1 to t3 and the second vector 314 moves from right to left from t1 to t3. At time t4, both vectors meet and affect each other's behavior. In this example, the controller 100 changes the directions of the vectors to opposite directions after the collision. In other examples, the controller 100 may change the color, brightness, speed, shape, size, lifetime or any other parameter of the vectors when they collide.

The controller 100 may be further configured to change at least one behavior parameter and/or at least one appearance parameter of a first vector when it collides with a second vector based on at least one behavior parameter and/or at least one appearance parameter of the second vector. In the example of FIG. 3, the controller 100 may determine the new direction of the first vector 312 after the collision at t4 based on the direction of the second vector 314 before the collision at t4, and vice versa. In other examples, the controller 100 may change the color, brightness, speed, shape, size, lifetime or any other parameter of a first vector based on a parameter of a second vector.

The controller 100 may be further configured to obtain or generate an area of influence, and the controller 100 may be further configured to map the area of influence onto the light source array 110. The controller 100 may be configured to determine the position of an area of influence relative to the light source array 110, for example based on a sensor input or a user input via a user interface, or to determine the position of the area of influence randomly, or based on a predefined position.

The area of influence may influence at least one behavior parameter and/or at least one appearance parameter of the vector when the vector passes/enters/exits the area of influence. The controller 100 may be configured to change at least one behavior parameter (e.g. speed, direction, lifetime, etc.) and/or at least one appearance parameter (e.g. color, brightness, size, shape, etc.) of the vector when the vector passes/enters/exits the area of influence. Additionally or alternatively, the controller 100 may generate an additional vector may be generated when the (initial) vector is located in the area of influence. The additional vector may have a starting point at the area of influence. The additional vector may have behavior and/or appearance parameters based on the (initial) vector that passed/entered/exited the area of influence.

Figure 4:
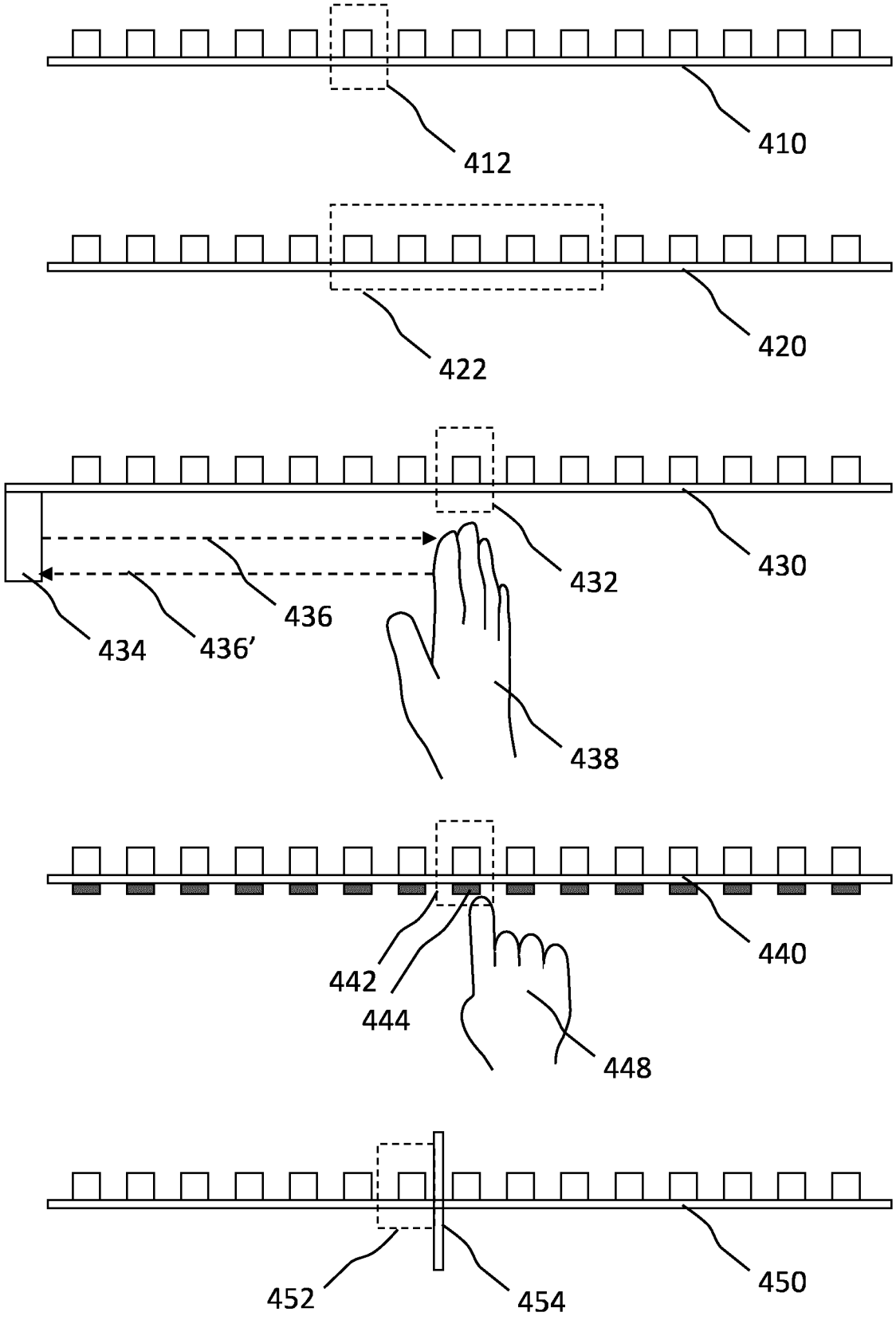
FIG. 4 shows schematically a plurality of embodiments of areas on influence that change the behavior and/or the appearance of a vector.

FIG. 4 illustrates multiple examples of areas of influence.

In a first example, an area of influence 412 may be located at a single light source or in between two light sources of a light source array 410. When a vector passes the area of influence 412, the controller 100 may change at least one behavior parameter and/or at least one appearance parameter of the vector, or the controller 100 may generate at least one additional vector if the vector enters/passes/exits the area of influence 412.

In a second example, an area of influence 422 may be located at a plurality of light sources of a light source array 420. When a vector is in the area of influence 422, the controller 100 may change at least one behavior parameter and/or at least one appearance parameter of the vector, or the controller 100 may generate at least one additional vector if the vector enters/passes/exits the area of influence 422. The controller 100 may further revert the change when the vector leaves the area of influence 422

In a third example, the position of an area of influence 432 may be based on a user input 438. The position of the user input 438 may be detected by a sensor 434 located at the light source array 430. The sensor 434 may be configured to transmit a sense signal 436 (for example an (ultra)sound signal, a radio signal) and determine the distance of the user input 438 (here: the hand of the user) based on a reflection 436' of the sense signal 436. The sensor 434 may have a predefined position relative to the light source array 430. The controller 100 may know the predefined position of the sensor and the length of the light source array and the spatial distribution of its light sources. This enables the controller 100 to calculate at which light source it has to position the area of influence 432. This enables a user to provide a user input 438, which will create the area of influence 432. As a result, the controller 100 may change at least one behavior parameter and/or at least one appearance parameter of the vector when it arrives at the area of influence 432, or the controller 100 may generate at least one additional vector if the vector enters/passes/exits the area of influence 432. For instance, the controller 100 may change the direction (e.g. from left-to-right to right-to-left) of a vector when it arrives at the area of influence 432, which creates the effect that the vector "bounces" off the user's hand 438.

In a fourth example, the position of an area of influence 442 may be based on a user input 448. The position of the user input 448 may be detected by a sensor 444 located at the light source array 440. The light source array 440 may comprise a plurality of such sensors, for example one at each light source or one at every other light source. The sensors may for example be touch sensitive sensors. The sensor 444 may transmit a signal to the controller 100 when it is actuated by a user. The controller 100 may have access to the position of the sensor 444 relative to the plurality of light sources on the light source array 440. This enables the controller 100 to determine at which light source it has to position the area of influence 442. This enables a user to provide a user input 448, which will create the area of influence 442. As a result, the controller 100 may change at least one behavior parameter and/or at least one appearance parameter of the vector when it arrives at the area of influence 442, or the controller 100 may generate at least one additional vector if the vector enters/passes/exits the area of influence 442. For instance, the controller 100 may change the color (e.g. from blue to red) of a vector when it arrives at the area of influence 442.

In a fifth example, the position of an area of influence 452 may be based on a location of an attachable component 454 relative to the light source array 450. The attachable component 454, such as a clip, a magnetic connector, a pin connector, etc., may have been attached to the light source array 450 by a user. The controller 100 may be configured to detect the location of the attachable component 454. The attachable component may, for example, connect to a data line of the light source array 450, which enables the controller 100 to determine its location. This enables a user to attach an attachable component 454, which will create the area of influence 452. As a result, the controller 100 may change at least one behavior parameter and/or at least one appearance parameter of the vector when it arrives at the area of influence 452, or the controller 100 may generate at least one additional vector if the vector enters/passes/exits the area of influence 452. For instance, the controller 100 may generate an additional vector when the (initial) vector arrives at the area of influence 442. The additional vector may have similar behavior and/or appearance parameters as the (initial) vector.

Figure 5:
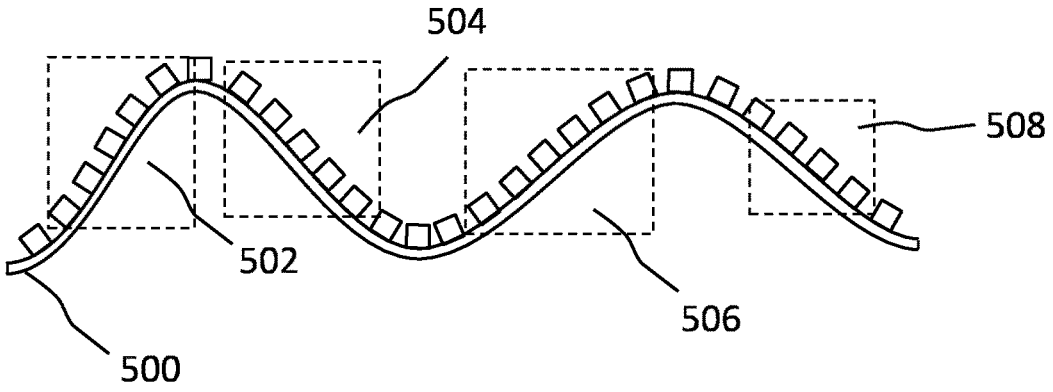
FIG. 5 shows schematically an embodiment of a flexible light strip with multiple areas of interest.

FIG. 5 illustrates another example wherein multiple areas of influence are mapped onto a (flexible) light source array 500. The controller 100 may be configured to generate and map the areas of influence such that they affect the behavior of vectors that pass the areas of influence such that vectors appear to be under influence physical/gravitational forces. In the example of FIG. 5, the controller 100 may map a vector onto the light source array 500 such that it moves from left to right across the light source array 500. When the vector arrives at a first area of influence 502 (and moves upward from a user's perspective), the movement speed of the vector may be decreased. When the vector arrives at a second area of influence 504 (and moves downward from a user's perspective), the movement speed of the vector may be increased. Areas of influence 506 and 508 may affect the behavior of the vector in a similar way.

The controller 100 may be further configured for determining the position of the area of influence based on one or more sensor inputs from sensors comprised in the light source array 110. The light source array 110 may, for example, comprise one or more orientation sensors (e.g. gyroscopes) configured to sense the orientation of (parts of) the light source array 110. In another example, the light source array 110 may comprise one or more height sensors configured to sense the height of (parts of) the light source array 110. In another example, the light source array 110 may, for example, comprise one or more flex sensors configured to sense the shape of the light source array 110. Referring to FIG. 5, the controller of the light source array may be configured to determine the orientation, height and/or shape of parts of the light source array 500 based on sensor inputs, and determine where to position which type of areas of influence.

Figure 6:
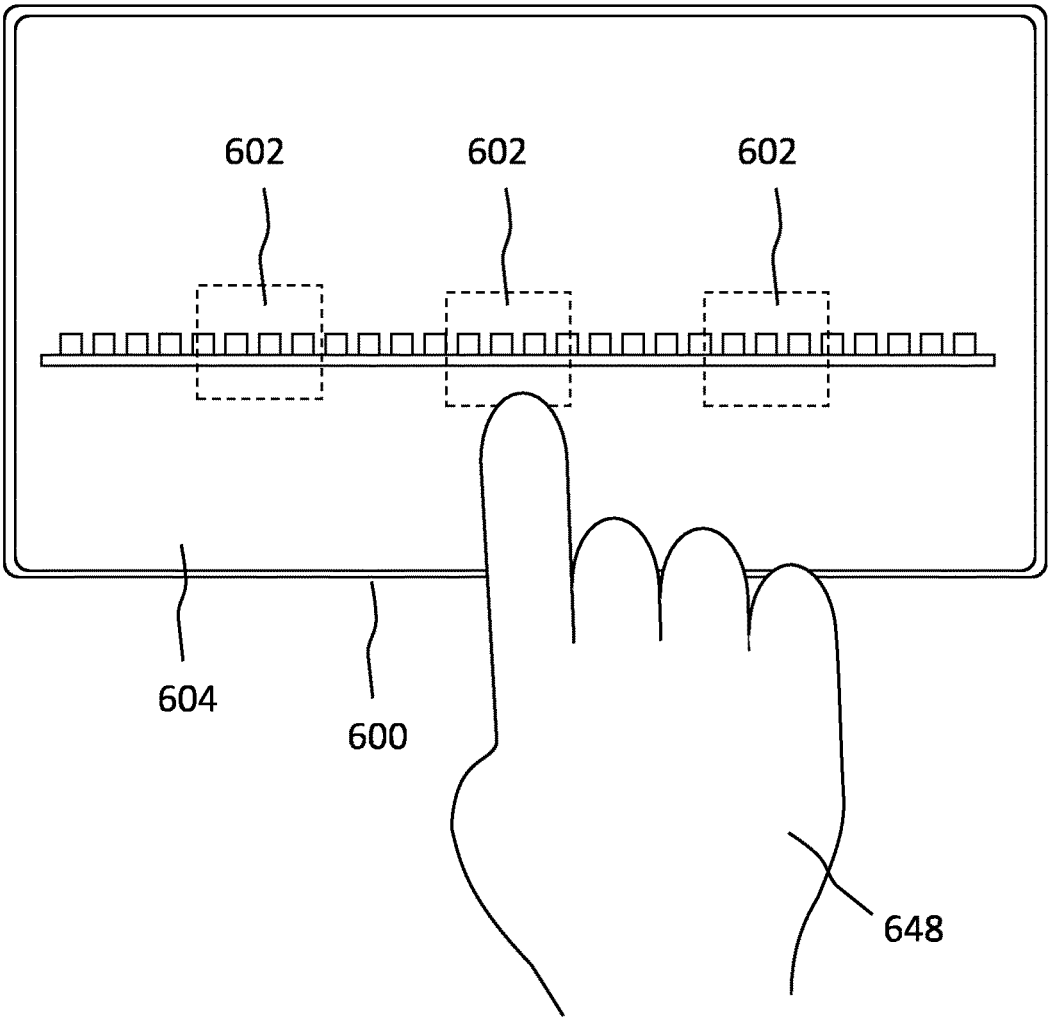
FIG. 6 shows schematically an embodiment of a user interface for providing user input to indicate positions of areas of interest.

The controller 100 may be further configured for determining the position of the area of influence based on one or more user inputs received via a user interface. The user interface may be integrated in the controller 100, or be integrated in a user device such as a smartphone, a smartwatch, a laptop pc, a tablet pc, etc. The user may provide user input to set the position(s) of the area(s) of influence and to select types of areas of influence. In the example of FIG. 6, the user may set the positions of the areas of influence 602 relative to the light source array. A user may further specify the shape and size of the area of influence, and select which behavior and/or appearance parameters are affected when a vector enters/exits/passes a specific area of influence.

The controller 100 may be configured to apply any change of a behavior parameter or an appearance parameter temporarily. An area of influence may, for example, influence a behavior parameter or an appearance parameter for a certain period of time. The period of time may be predefined, random, or based on a user input received via a user interface. In embodiments wherein the controller 100 is configured to generate additional vectors, the additional vectors may have a limited lifetime, and may therefore also be temporary. The lifetime of additional vectors may be predefined, random or based on a user input received via a user interface.

The controller 100 may be configured to receive lighting control commands comprising information about a number of vectors that are to be mapped on the light source array 110 and about their behavior parameters and appearance parameters. The lighting control commands may for example be received from a user device, such as a smartphone, a smartwatch, a laptop pc, a tablet pc, etc. The user device, or the controller 100 itself, may comprise a user interface configured to received user input indicative of a number of vectors that are to be mapped on the light source array 110 and about their behavior parameters and appearance parameters. A user may, for example, define the starting positions of one or more vectors, their color, their brightness, their speed, their direction, their lifetime and/or what happens when they collide with other vectors.

Figure 7:
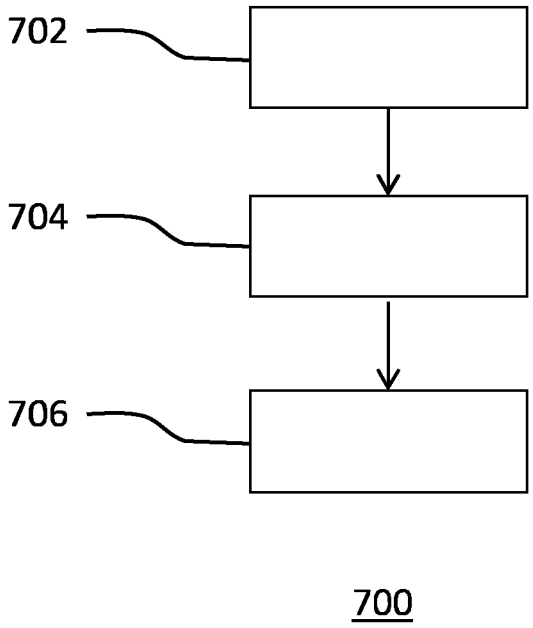
FIG. 7 shows schematically a method of generating a dynamic light effect on a light source array.

FIG. 7 shows schematically a method 700 of generating a dynamic light effect on a light source array 110, which light source array 110 comprises a plurality of individually controllable light sources 112. The method 700 comprises:

obtaining 702 or generating 702 a vector, wherein the vector has a plurality of behavior parameters comprising at least a speed and a direction, and the vector has one or more appearance parameters comprising at least a color and/or a brightness, mapping 704 the vector onto the light source array 110 over time according to the behavior parameters of the vector, and controlling 706 the light output of the plurality of light sources 112 over time according to the mapping of the vector onto the light source array 110 and according to the appearance parameters of the vector.

The method 700 may be executed by computer program code of a computer program product when the computer program product is run on a processing unit of a computing device, such as the controller 100.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer or processing unit. In the device claim enumerating several means, several of these means may be embodied by one and the same item of hardware. The mere fact that certain measures are recited in mutually different dependent claims does not indicate that a combination of these measures cannot be used to advantage.

Aspects of the invention may be implemented in a computer program product, which may be a collection of computer program instructions stored on a computer readable storage device which may be executed by a computer. The instructions of the present invention may be in any interpretable or executable code mechanism, including but not limited to scripts, interpretable programs, dynamic link libraries (DLLs) or Java classes. The instructions can be provided as complete executable programs, partial executable programs, as modifications to existing programs (e.g. updates) or extensions for existing programs (e.g. plugins). Moreover, parts of the processing of the present invention may be distributed over multiple computers or processors.

Storage media suitable for storing computer program instructions include all forms of nonvolatile memory, including but not limited to EPROM, EEPROM and flash memory devices, magnetic disks such as the internal and external hard disk drives, removable disks and CD-ROM disks. The computer program product may be distributed on such a storage medium, or may be offered for download through HTTP, FTP, email or through a server connected to a network such as the Internet.

The invention claimed is:

1. A method of generating a dynamic light effect on a light source array, the light source array comprising a plurality of individually controllable light sources, the method comprising:

obtaining or generating a vector, wherein the vector has a plurality of behavior parameters comprising at least a speed and a direction, and the vector has one or more appearance parameters comprising at least a color and/or a brightness, mapping the vector onto the light source array over time according to the behavior parameters of the vector, and controlling the light output of the plurality of light sources over time according to the mapping of the vector onto the light source array and according to the appearance parameters of the vector, wherein an area of influence is mapped onto the light source array, and wherein the method further comprises:

changing at least one behavior parameter and/or at least one appearance parameter of the vector if the vector is located in the area of influence, or generating at least one additional vector if the vector is located in the area of influence, wherein the area of influence is mapped at a location relative to the light source array based on a user input indicative of a selection of an input location relative to the light source array, and wherein the light source array comprises one or more sensors for receiving the user input.

2. The method of claim 1, wherein the plurality of behavior parameters further comprises an initial starting position of the vector, and wherein the vector is mapped onto the light source array at the initial starting position.

3. The method of claim 1, wherein the one or more appearance parameters further comprise a shape and/or a size of the vector.

4. The method of claim 1, wherein the plurality of behavior parameters further comprises a lifetime of the vector.

5. The method of claim 4, further comprising: changing at least one behavior parameter, other than the lifetime, and/or at least one appearance parameter of the vector as a function of the lifetime.

6. A computer program product for a computing device, the computer program product comprising computer program code to perform the method of claim 1 when the computer program product is run on a processing unit of the computing device.

7. The method of claim 1, wherein the area of influence is mapped at a location relative to the light source array based on a location of an attachable component relative to the light source array, which attachable component has been attached to the light source array by a user.

8. The method of claim 1, further comprising:

changing, if the vector collides with a second vector, at least one behavior parameter and/or at least one appearance parameter of the vector.

9. The method of claim 8, wherein the change of the at least one behavior parameter and/or the at least one appearance parameter of the vector is based on at least one behavior parameter and/or at least one appearance parameter of the second vector.

10. The method of claim 1, wherein the change of the at least one behavior parameter and/or the at least one appearance is temporary.

11. The method of claim 1, wherein at least one of the plurality of behavior parameters and/or at least one of the appearance parameters is defined by a user.

12. The method of claim 1, wherein the method comprises receiving a lighting control command comprising the vector.

13. A controller for generating a dynamic light effect on a light source array, the light source array comprising a plurality of individually controllable light sources, wherein the controller is configured to:

obtain or generate a vector, wherein the vector has a plurality of behavior parameters comprising at least a speed and a direction, and the vector has one or more appearance parameters comprising at least a color and/or a brightness, map the vector onto the light source array over time according to the behavior parameters of the vector, and control the light output of the plurality of light sources over time according to the mapping of the vector onto the light source array and according to the appearance parameters of the vector, wherein an area of influence is mapped onto the light source array, and wherein the controller is further configured to:

change at least one behavior parameter and/or at least one appearance parameter of the vector if the vector is located in the area of influence, or generate at least one additional vector if the vector is located in the area of influence wherein the area of influence is mapped at a location relative to the light source array based on a user input indicative of a selection of an input location relative to the light source array, and wherein the light source array comprises one or more sensors for receiving the user input.

* * * * *